US006872111B2

(12) United States Patent
Katz et al.

(10) Patent No.: US 6,872,111 B2
(45) Date of Patent: Mar. 29, 2005

(54) KICKBOARD

(76) Inventors: Robert Katz, 3570 Ridgewood, #305, Montréal, Quebec (CA), H3V 1C2; Sylvain Duchesne, 5338 Chabot, Montréal, Quebec (CA), H2H 1Y8

( * ) Notice: Subject to any disclaimer, the term of this patent is extended or adjusted under 35 U.S.C. 154(b) by 0 days.

(21) Appl. No.: 10/356,609

(22) Filed: Feb. 3, 2003

(65) Prior Publication Data

US 2004/0152377 A1 Aug. 5, 2004

(51) Int. Cl.[7] ..... A63B 69/12
(52) U.S. Cl. ..... 441/129; 441/65; 434/254
(58) Field of Search ..... 441/65, 66, 74, 441/75, 79, 129, 130; 434/254; D21/769, 770, 801, 803; 446/153; 472/128, 129

(56) References Cited

U.S. PATENT DOCUMENTS

| | | | | | |
|---|---|---|---|---|---|
| D194,646 | S | * | 2/1963 | Del Mar | D21/769 |
| D195,384 | S | * | 6/1963 | Del Mar | D21/769 |
| D199,470 | S | * | 10/1964 | Ziff | D21/770 |
| D238,106 | S | * | 12/1975 | Arblaster | D24/183 |
| D244,315 | S | * | 5/1977 | Havstad | D24/183 |
| D246,066 | S | | 10/1977 | O'Farrell | |
| 4,362,518 | A | * | 12/1982 | Boissiere | 441/60 |
| 4,666,414 | A | * | 5/1987 | Fox et al. | 441/129 |
| 4,781,638 | A | | 11/1988 | Winters, Jr. | |
| 4,932,912 | A | * | 6/1990 | Combs | 441/129 |
| 5,101,752 | A | * | 4/1992 | Smollar et al. | 114/345 |
| 5,247,898 | A | * | 9/1993 | Thornlimb | 114/246 |
| 5,797,779 | A | | 8/1998 | Stewart | |
| 6,083,067 | A | * | 7/2000 | McCredie | 441/129 |
| 6,203,389 | B1 | * | 3/2001 | Pearson | 441/65 |
| D440,271 | S | * | 4/2001 | Chiang | D21/803 |
| D440,619 | S | * | 4/2001 | Chiang | D21/803 |
| D446,569 | S | * | 8/2001 | Chiang | D21/803 |
| D461,516 | S | * | 8/2002 | Chen | D21/770 |

OTHER PUBLICATIONS

"TYR Streamline Training Board" from http://www.tyr.com/images/streamline.jpg and http://www.jdpence.com/home/jd1/page/460/64, on sale date of at least Nov. 26, 2002 established using http://www.archive.org.*

* cited by examiner

*Primary Examiner*—Andrew D. Wright

(57) ABSTRACT

A kickboard comprising a relatively thin, buoyant board no longer than twenty six inches. The board has a back edge and a front edge joined by side edges. The board also has top and bottom surfaces joined by the front, back and side edges. Two, spaced-apart, forearm receiving depressions are provided in the top surface of the board, the depressions extending forwardly from the back edge of the board over a major portion of the length of the board to near the front edge. The depressions help to retain the forearms of a swimmer using the board on the board. The kickboard has hand grips located in front of the forearm receiving depressions. Preferably, at least the front portions of the side edges are bent toward each other, and the hand grips are located on the bent front portions, preferably just in front of, and aligned with, the forearm receiving depressions. Gripping the bent front portions allows the wrists to remain in a normal position relative to the forearms thus reducing stress.

18 Claims, 1 Drawing Sheet

KICKBOARD

BACKGROUND OF THE INVENTION

1. Field of the Invention

This invention is directed toward a kickboard.

The invention is more particularly directed toward a kickboard having forearm supports in the top surface of the board and a kickboard having hand grips at the front of the board, the hand grips preferably aligned with the forearm supports.

2. Description of the Related Art

Kickboards are used by swimmers to practice their kicking action while swimming. The swimmer normally holds the board with two hands out in front of him while swimming and propels himself through the water solely by kicking his legs. The board is buoyant and not very long so that the swimmer can hold it in front of him without his head hitting the board.

Training sessions using kickboards can be long and it gets tiring holding the board. The forearms rest on the smooth upper surface of the board and can move about, even sliding off the board, making it more tiring. Some boards are gripped at the front but the gripping action, obtained by curling all the fingers about the front of the board, tires the hands since the hands must be rotated slightly from their natural rest position relative to the forearms to grip the board.

SUMMARY OF THE INVENTION

It is the purpose of the present invention to provide a small, lightweight, kickboard that is easy to use and that is less tiring, than known kickboards, to use.

In accordance with the present invention there is provided a kickboard having a front edge and a back edge, the front and back edges joined by side edges. The front, back and side edges connect top and bottom surfaces of the kickboard. The kickboard has two longitudinal extending forearm receiving depressions in the top surface of the board, the depressions spaced apart and extending forwardly from the back edge, over a major portion of the length of the board, to near the front edge of the board. The depressions help retain the swimmer's forearms on the board during use of the board.

The kickboard further includes hand grips adjacent the side edges of the board, the hand grips located just in front of the arm receiving depressions. The hand grips preferably have a slight bump on the top surface of the board adjacent the side edge of the board, the bump generally shaped to receive the palm of the swimmer's hand when the hand is slightly cupped to grip the side edge of the board. On the bottom surface of the board, the hand grips include a finger receiving depression adjacent the side of the board for receiving the ends of the swimmer's fingers which are wrapped about the sides of the board while the palm cups the bump.

Preferably, at least the front portions of the side edges are bent toward each other in a direction toward the front edge of the board. The hand grips are located in the bent front portions of the side edges and preferably are just in front of the arm receiving depressions and aligned with them. Locating the grips on the bent or angled side edges allows a more natural and comfortable grip on the board and locating the grips to be aligned with the arm receiving depressions also allows for a more natural gripping position thus reducing stress on the hands and arms. The hands and wrists are in a natural or normal position relative to the forearms when gripping the board with little or no ulnar or palmar deviation of the wrists relative to the forearms.

The invention is particularly directed toward a kickboard comprising a relatively thin, buoyant board no longer than twenty six inches. The board has a back edge and a front edge joined by side edges. The board has top and bottom surfaces joined by the front, back and side edges. Two, spaced-apart, forearm receiving depressions are provided in the top surface of the board, the depressions extending forwardly from the back edge of the board over a major portion of the length of the board to near the front edge. Each depression is wide enough to comfortably receive the foreman of a user, the forearm lying between the sides of the depression over the length of the depression.

The kickboard has hand grips located just in front of the forearm receiving depressions. Preferably, at least the front portions of the side edges are bent toward each other, and the hand grips are located on the bent front portions, preferably just in front of, and aligned with, the depressions.

DESCRIPTION OF THE PREFERRED EMBODIMENTS

Figure 1:
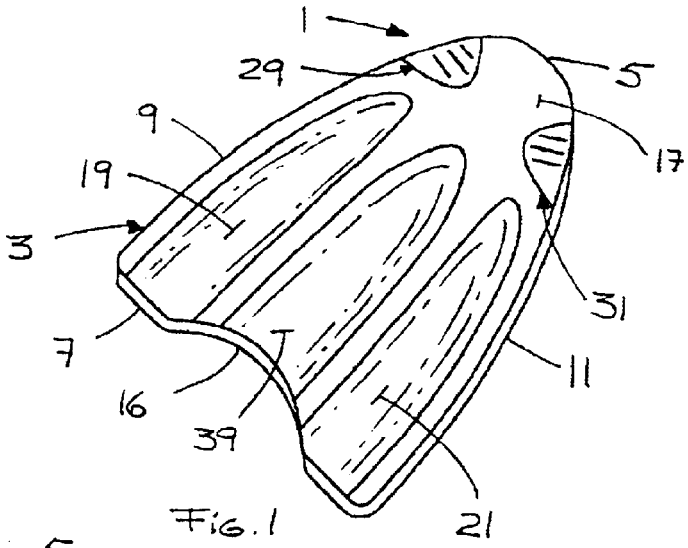
FIG. 1 is a perspective view of the board.
Figure 2:
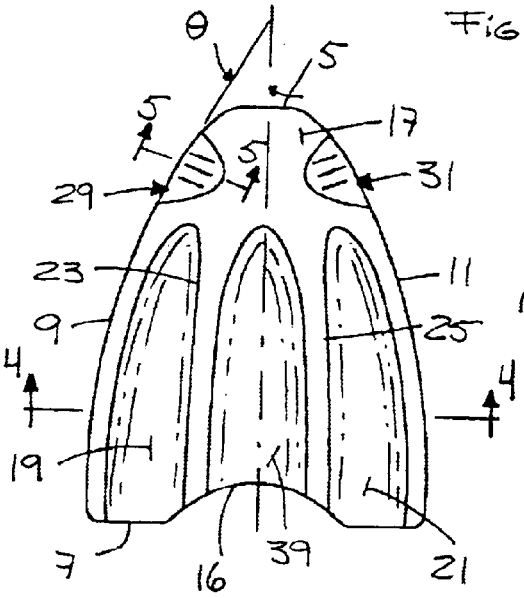
FIG. 2 is a top view of the board.
Figure 3:
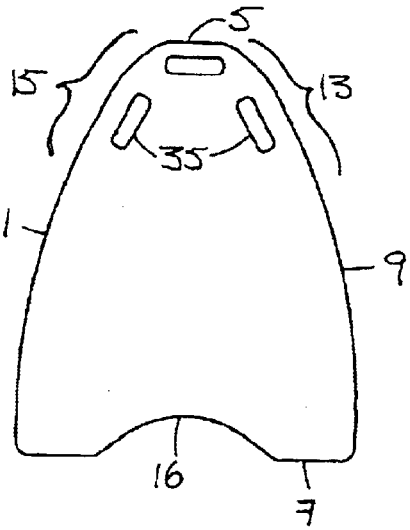
FIG. 3 is a bottom view of the board.

The kickboard 1, as shown in FIGS. 1 to 3, comprises a relatively thin board 3 of buoyant material having a front edge 5, a rear edge 7 and side edges 9, 11 joining the front and rear edges 5, 7 together. At least the front portions 13, 15 of the side edges 9, 11 respectively, are bent toward each other in a direction to the front of the board. To provide a board with at least the front portions of the side edges angled toward each other, the board can have a generally triangular shape as shown. For the generally triangular shape, the front edge 5 is relatively short compared to the back edge 7. The side edges 9, 11 can bend slightly inwardly moving from the back toward the front, and then bend more sharply toward each other near the front of the board, as shown by front portions 13, 15. The side edges 9, 11 merge smoothly into the front edge 5. The center 16 of the rear edge 7 can be scalloped inwardly as shown in FIG. 2. The board has top and bottom surfaces 17, 18 joined by the front 5, rear 7 and side edges 9, 11, the edges merging smoothly into the top and bottom surfaces.

While the board has been shown with a triangular shape, the board can have other shapes where the front portions of the side edges are bent or angled toward each other such as, for example: an egg shape; a blunted, arrowhead shape; or with a somewhat rectangular rear section with a triangular section adjacent one narrow side of the rectangular section, the triangular section forming the front of the board. In general, the board is slightly longer than it is wider and is no longer than twenty six inches, normally being around twenty inches in length.

Figure 4:
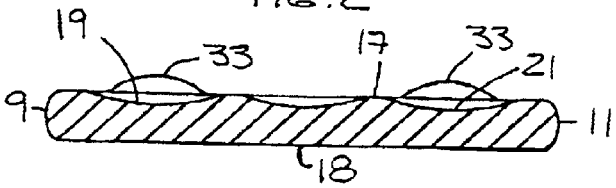
FIG. 4 is a cross-section view taken along line 4—4 in FIG. 2.

The top surface 17 of the board 3 has first and second spaced-apart forearm receiving depressions 19, 21 extending forwardly from the rear edge 7 as shown in FIGS. 1, 2 and 4. The two depressions 19, 21 extend over a major portion of the length of the board. The two depressions 19, 21 are each concave in cross-section, relatively shallow and just wide enough to comfortably receive a forearm of the user, the forearm lying within the sides of the depression over the length of the depression. The depressions 19, 21 terminate near the front of the board and are adjacent to the side edges 9, 11 respectively. The inner sides 23, 25 of the depressions are relatively straight and parallel but the inner sides could also be angled slightly inwardly toward each other in a direction toward the front.

Figure 5:
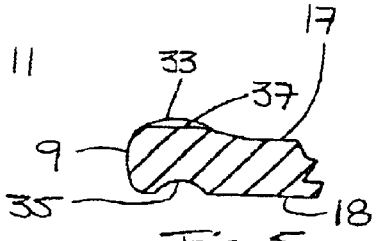
FIG. 5 is a cross-section view taken along line 5—5 in FIG. 2.

The board is provided with a pair of hand grips 29, 31, one adjacent each front portion 13, 15 of each side edge 9, 11 respectively, of the board, the hand grips just in front of the depressions 19, 21. Each hand grip 29, 31 is identical but reversed from the other so only one will be described in detail. Hand grip 29 has a rounded palm bump 33 on the top surface 17 of the board adjacent the side edge 9, as shown in FIGS. 1, 2 and 5, the bump 33 shaped and sized to fit within the palm of a user's hand. The hand grip 29 includes a shallow finger receiving depression 35 in the bottom surface 19 of the board, the finger receiving depression 35 generally located under the palm bump 33, and located just inwardly from the side edge 9 as shown in FIGS. 3 and 5. Both the palm bump 33 and the finger depression 35 can be roughened with either ribs or grooves 37 on their surfaces to provide better contact.

In use, the user grasps both hand grips 29, 31 with his hands while his forearms rest in the forearm depressions 19, 21. The user's hands have the fingers curled about the side edges 9, 11 of the board 3 with the finger tips resting in the finger depressions 35 on the bottom surface 18 of the board 3 and the palms of the user's hands cupped and resting on the palm bumps 33 on the top surface 17 of the board. The thumbs of the user's hands would rest on the top surface 17 of the board 3 adjacent the side edges 9, 11. The forearms are retained in position by the forearm depressions 19, 21 while the hands are held in position by cupping the bumps 33 and having the fingers curl naturally about the side edges 9, 11 of the board into the finger depressions 35.

Preferably, the board is shaped, and the hand grips 29, 31 are positioned on the front portions 13, 15 of the side edges 9, 11, to have the hand grips just in front of the forearm depressions and longitudinally aligned with the forearm depressions as shown in FIG. 2. The front portions 13, 15 of the side edges 9, 11, in this location, are at an angle to longitudinal axis of the kickboard, that allows the hands to grasp the grips 29, 31 naturally with the wrist in a normal relaxed position with little or no ulnar or palmar deviation of the wrist relative to the forearm. This angle $\theta$ is about 40°. The angle can vary between 30° and 50° but wrist deviation is greater at the outer limits. This arrangement allows the fingers to naturally grip the side edges at an angle to the forearms, with the wrists in a natural, normal position relative to the forearms, thereby providing a comfortable, relatively stress-free grip.

The board 3 can include a third forearm receiving depression 39 extending up the center of the board between the other two arm depressions 19, 21, the third arm depression 39 extending from the scalloped center 16 of the rear edge 7 to near the front edge. The third forearm depression 39 is similar to the first and second depressions in having a concave bottom, when seen in cross-section, relatively shallow, and just wide enough to comfortably receive the forearm, with the forearm lying in the depression between the sides of the depression over the length of the depression. A third finger receiving depression 41 is located in the bottom surface 18 of the board 3 just behind the front edge 5 and generally parallel to it as shown in FIG. 3. The third forearm depression 39 is used when the swimmer is holding the kickboard with only one hand, usually when practicing kicking with a side stroke. The scalloped center 16 on the rear edge 7 makes the distance from the rear edge 7, over the third arm depression 39, to the front edge 5 of the board, about the same as the distance from the rear edge 7 over either the first or second depression 19, 21 to the hand grip 29, 31 respectively in front of them.

The kickboard is relatively short, no longer than twenty six inches, and usually around twenty inches long, so that the swimmer can put his head between his forwardly extending arms while holding the board, his forearms supported in the arm depressions on top of the board, and practice breathing without interfering with the kickboard. The length of the kickboard will vary depending on the height of the user. The kickboard can be molded in one piece from any suitable thermoplastic material, which material is buoyant and relatively stiff.

We claim:

1. A kickboard comprising a relatively thin, buoyant board no longer than twenty six inches, the board having: a back edge and a front edge joined by unbroken side edges; at least the front portions of the side edges bent toward each other in a direction toward the front of the board; top and bottom surfaces joined by the front, back and side edges; first and second spaced-apart, straight forearm receiving depressions in the top surface of the board, the depressions extending forwardly from the back edge of the board over a major portion of the length of the board to near the front edge, each depression having a concave cross-sectional shape, the depression being shallow yet deep enough to retain the forearm in the depression during use of the kickboard, the depression being wide enough to comfortably receive the forearm in the depression between the sides of the depression over the length of the depression and hand grips located on the front portions of the side edges, one hand grip on each front portion spaced from, and just directly in front of, one forearm depression.

2. A kickboard as claimed in claim 1 including a third forearm receiving depression in the top surface of the board, the third depression centrally located on the top surface between the first and second depressions and extending forwardly from the back edge of the board over a major portion of the length of the board to near the front edge, the third depression wide enough to comfortably receive the forearm in the depression between the sides of the depression over the length of the depression.

3. A kickboard as claimed in claim 1 wherein each hand grip has a single, rounded bump on the upper surface adjacent the side edge of the board, the bump shaped and sized to receive the palm of a user's hand.

4. A kickboard as claimed in claim 3 wherein each hand grip includes a finger receiving depression in the bottom surface of the board under the bump, the finger receiving depression near the side edge of the board and generally parallel to it.

5. A kickboard as claimed in claim 1 including a third forearm receiving depression in the top surface of the board, the third depression centrally located on the top surface between the first and second depressions and extending forwardly from the back edge of the board over a major portion of the length of the board to near the front edge.

6. A kickboard as claimed in claim 5 including a third hand grip on the board adjacent the front edge, the third hand grip aligned with the third forearm depression, the third hand grip comprising a front finger receiving depression in the bottom surface of the board, the front finger depression near the front edge of the board.

7. A kickboard as claimed in claim 1 wherein each hand grip has a single, rounded bump on the upper surface adjacent the side edge of the board, the bump shaped and sized to receive the palm of a user's hand.

8. A kickboard as claimed in claim 7 wherein each hand grip includes a finger receiving depression in the bottom surface of the board under the bump, the groove near the side edge of the board and generally parallel to it.

9. A kickboard as claimed in claim 8 including a third forearm receiving depression in the top surface of the board, the third depression centrally located on the top surface between the first and second depressions and extending forwardly from the back edge of the board over a major portion of the length of the board to near the front edge.

10. A kickboard as claimed in claim 1 including a third forearm receiving depression in the top surface of the board, the third depression centrally located on the top surface between the first and second depressions and extending forwardly from the back edge of the board over a major portion of the length of the board to near the front edge.

11. A kickboard as claimed in claim 10 including a third hand grip on the board adjacent the front edge, the third hand grip aligned with the third forearm depression, the third hand grip comprising a front finger receiving depression in the bottom surface of the board, the front finger depression near the front edge of the board.

12. A kickboard as claimed in claim 10 wherein the back edge is scalloped inwardly between the first and second depressions and the distance from the back edge to the hand grip over the first and second depressions is about the same as the distance from the back edge to the front edge over the third depression.

13. A kickboard as claimed in claim 1 wherein each hand grip is longitudinally aligned with a forearm depression and wherein the front portions of the side edges, where the hand grips are located, extend at an angle to the longitudinal axis of the kickboard ranging between 30° and 50°.

14. A kickboard as claimed in claim 13 wherein each hand grip has a single, rounded bump on the upper surface adjacent the side edge of the board, the bump shaped and sized to receive the palm of a user's hand.

15. A kickboard as claimed in claim 14 wherein each hand grip includes a finger receiving depression in the bottom surface of the board under the bump, the finger receiving depression near the side edge of the board and generally parallel to it.

16. A kickboard as claimed in claim 13 including a third forearm receiving depression in the top surface of the board, the third depression centrally located on the top surface between the first and second depressions and extending forwardly from the back edge of the board over a major portion of the length of the board to near the front edge.

17. A kickboard as claimed in claim 16 including a third hand grip on the board adjacent the front edge, the third hand grip aligned with the third forearm depression, the third hand grip comprising a front finger receiving depression in the bottom surface of the board, the front finger depression near the front edge of the board.

18. A kickboard as claimed in claim 16 wherein the back edge is scalloped inwardly between the first and second depressions and the distance from the back edge to the hand grip over the first and second depressions is about the same as the distance from the back edge to the front edge over the third depression.

* * * * *